US005088757A

United States Patent [19]

Hauglin

[11] Patent Number: 5,088,757

[45] Date of Patent: Feb. 18, 1992

[54] LATERAL GUIDE DEVICE FOR A SKI BOOT

[75] Inventor: Bernt-Otto Hauglin, Oslo, Norway

[73] Assignee: Witco A-S, Norway

[21] Appl. No.: 578,872

[22] Filed: Sep. 4, 1990

[30] Foreign Application Priority Data

Sep. 4, 1989 [DE] Fed. Rep. of Germany ..... 3929352

[51] Int. Cl.[5] ..... A63C 9/20

[52] U.S. Cl. ..... 280/615; 24/68 SK; 280/636; 403/4; 403/13

[58] Field of Search ..... 280/615, 633, 634, 636; 36/117; 24/68 SK, 70 R; 403/13, 14, 4; 52/98

[56] References Cited

U.S. PATENT DOCUMENTS

| | | | |
|---|---|---|---|
| 3,614,117 | 10/1971 | Iizuka | 280/633 |
| 4,335,531 | 6/1982 | Solomon | 36/117 |
| 4,487,427 | 12/1984 | Salomon | 280/615 |
| 4,583,334 | 4/1986 | Hubbard | 52/98 |
| 4,772,041 | 9/1988 | Klosterman | 280/633 X |
| 4,843,783 | 7/1989 | Taravella | 52/98 |
| 4,932,174 | 6/1990 | Anderson | 52/98 |

FOREIGN PATENT DOCUMENTS

| | | | |
|---|---|---|---|
| 1195649 | 6/1965 | Fed. Rep. of Germany | 280/633 |
| 377446 | 8/1979 | Fed. Rep. of Germany . | |
| 3320559 | 12/1983 | Fed. Rep. of Germany . | |
| 3527219 | 2/1986 | Fed. Rep. of Germany . | |
| 3838569 | 6/1989 | Fed. Rep. of Germany . | |
| 3924899 | 2/1990 | Fed. Rep. of Germany | 280/633 |

*Primary Examiner*—Andres Kashnikow
*Assistant Examiner*—Michael Mar
*Attorney, Agent, or Firm*—Andrus, Sceales, Starke & Sawall

[57] ABSTRACT

A lateral guide device for a ski boot is disclosed which may be joined by its front end to a binding (13) with a housing (19). The bonding is fastened onto the ski such that the boot heel may be tilted upwardly relative to the ski. The device includes at least one longitudinal guide rib unit (12) cooperating with a complementary longitudinal groove at the underside of the sole of the ski boot so as to ensure a lateral guidance of the ski boot when the latter is rolled from an upwardly tilted position into a position approximately parallel to the ski. For the purpose of adaptation of the device to different shoe sizes and for facilitated assembly, the longitudinal guide rib unit (12) may be connected, with positive locking action, either directly to the binding (13) or the binding housing (19), respectively, or through a rear section (11) to a front section (10) of the longitudinal guide rib unit (12), which is preferably joined to the binding (13). The longitudinal guide rib unit (12) or the rear section (11) where provided includes at least one breakable segment (16) in the connecting zone (26) of the rib unit which is located specifically in the region of the plantar arch of the ski boot.

12 Claims, 1 Drawing Sheet

13
19
18

23
24
21
22

10
15
18
12
20
17
16
16
14
11
12
11
25
26

17
16
22
17

LATERAL GUIDE DEVICE FOR A SKI BOOT

DESCRIPTION

The present invention relates to a lateral guide device for a ski boot and particularly a ski boot secured to a ski binding at the toe-end and with the heel-end free to tilt upwardly.

The most different devices have already become known which ensure the lateral guidance of a cross-country ski boot relative to the ski onto which the shoe is fixed. Some of these devices resort to a longitudinal guide rib which is attached onto the upper side of the ski or which is an integral component of the ski or the binding or the binding body, with the rib cooperating with a complementary longitudinal groove at the underside of the sole of the boot so as to ensure the lateral guidance of the boot when the latter rolls from its position with an upwardly tilted heel into a position approximately parallel to the ski. The longitudinal ribs themselves may present different designs in terms of both cross-section and extension of their upper edges and their number, as becomes evident, for instance, from the Patents Nos. AT-B-377 446, DE-A-38 38 569 or U.S. Pat. No. 4,335,531. From the prior art document AT-B-377 446 it is known to subdivide the longitudinal guide rib into two sections, i.e. a front section whose height decreases from the front edge rearwardly, and a joining section with a reduced, however substantially constant height. The first section is effective approximately in the toe region of the shoe while the second section becomes effective in the region of the metatarsus. The longitudinal guide rib according to U.S. Pat. No. 4,335,531 excels itself by the fact that its height, in the region in front of the heel or in the region of the plantar arch, constantly increases in a direction from the front to the rear. Similar conditions prevail with the longitudinal guide rib according to DE-A-38 38 569, which, however, includes additionally a fourth section in the region of the heel of the foot or the shoe, respectively, which presents either a constant or a rearwardly decreasing height. In a preferred embodiment, this fourth section is characterized by a transversely extending indentation which constitutes a region of reduced resistance so that the length of the longitudinal guide rib may be broken for varying it to provide for adaptation to the length or the size of a shoe.

SUMMARY OF THE INVENTION

The present invention is directed to a ski boot guide device including a longitudinal guide rib unit for securement to a ski binding unit with a structure to vary the length of the rib unit and which is substantially easier to mount than the known devices of this kind.

Generally, in accordance with this invention, a lateral guide device is provided for a ski boot having a sole adapted to be connected to a binding (13) attached on a ski such that the heel may be tilted upwards relative to the ski. A boot support has a securement device for attachment to the top surface of a ski and includes at least one longitudinal guide rib unit extending parallel from the front to the back of the ski. The rib unit is adapted to mate with a complementing longitudinal groove in the underside of the sole of the ski boot. The guide rib unit provides lateral guidance of the ski boot in a rolling movement of the ski boot from an upwardly tilted position downwardly to a position approximately parallel to the ski. The securement device for the longitudinal guide rib unit positively locks to the ski binding, and includes at least one breakable segment in a connecting zone adjacent the binding and the area of the ski boot.

Due to the positively locking connection of the longitudinal guide rib unit to the body of the binding, which preferably includes an integral guide rib unit specifically for the toe and the metatarsal regions, the separate longitudinal guide rib unit includes a single fastening means such as a screw for attachment on the ski or the top surface of the ski, respectively. The front end of the separate guide rib unit is retained, with positive the locking action and thus in a torsion-resistant manner even with attachment by means of a screw, at the body of the binding or at the front section of the longitudinal guide rib. In concrete terms, the connection is established.

The front of the rib unit includes a breakaway section with a flat front crossbar provided at the front end of the rib unit adjacent the binding and similar flat breakaway crossbars are provided between a plurality of separable segments. The flat crossbars project freely from the front segment of the breakaway portion and a transverse groove in the binding unit (13) complements and receives the front flat crossbar for securing the front end of the longitudinal rib unit to the ski binding and the ski.

At the same time, the overall length of the guide device may be matched with the length or the size of a shoe as the longitudinal guide rib unit including one formed as a rear section thereof presents at least one breakable segment in the front junction zone, preferably approximately in the region of the plantar arch. This zone is specifically well suited for the disposition of breakable segments since it has only a subordinate function in terms of lateral guidance. What is essential for a good lateral guidance is the toe and the metatarsal region as well as the heel region of the shoe sole (in particular for cross-country skiing and the Telemark style). Thus according to the present invention, the intermediate zone of the plantar arch, which is less relevant for the lateral guidance function, is used for the provision of breakable segments for the purpose of length matching of the lateral guide system to an established shoe size. This region is the most uncritical in terms of load, too, so that it is particularly well suited for the formation of rated breaking points, it being understood that these rated breaking points should become effective, i.e. break, only in the event of intentional separation of one or several segments for the inventive applications.

The specific design of the device with a break away section to match changes in boot sizes as well as with a plurality of break away sections entails not only the advantage of good functionality but moreover the advantage of uncomplicated production by means of an injection-molding process (one-shot process).

The provisions of cross-bars connected by special connections to segments are particularly effective in terms of both the arrangement of defined rated breaking points and assembly. The edged junctions between the crossbar and the segment constitute well-defined rated breaking points when one segment include a rear rounded-off junction and a forward or thorthorgonally designed corner or junction is broken our in a direction from the preferably orthogonally designed corner. The rounded-off junction in the zone of the opposite corner prevents the crossbar from being broken off simultaneously when one segment is removed in the aforedescribed manner. This crossbar has an essential function in the positive locking to the body of the binding or at the front section of the longitudinal guide rib unit, with a specifically flat design being possible when the crossbars and segments are designed with the bottom with surfaces in a common bottom plane.

The breakable segments preferably include intermediate sections of the longitudinal guide rib, too, so that a quasi-continuous longitudinal guide rib unit will constantly be ensured, which extends from the toe region to the region below the heel even if with a varied length of the longitudinal guide rib unit due to the removal of one or several segments.

The aforementioned advantage which results from the positive locking of the longitudinal guide rib unit or a rear section is structurally formed with a mounting plate having a single opening which preferably has a slightly elongate slot shape for compensation of tolerances in assembly and relative sliding movements between the comparatively rigid longitudinal guide rib and the associated mounting plate which with respect to the body of the ski which is subjected to elastic bending loads in cross-country skiing.

Moreover, the crossbars which are disposed between the segments and noticeably weaker, specifically with a less thick dimensioning, present defined weak points which render the device comparatively elastic under bending loads so that it may thus be well adapted or adapt itself well to the arch of the top surface of the ski in assembly as well as to variations of this arcuate shape in cross-country skiing as a result of the constantly varying loads.

Optionally, the ribs may vary in height from the front to the back, depending on exterior conditions, specifically on the main application of the skis equipped with a binding and a device of the type here in question. With the height of the longitudinal guide rib(s) increasing from the front end rearwardly in the zone of the shoe heel, it is particularly expedient for the user to prefer the so-called Telemark technique and style or to use the skis preferably for cross-country skiing tours including comparatively mane and/or long downhill slides.

The following is a more detailed explanation of an embodiment of the inventive device with reference to the attached drawing wherein:

DESCRIPTION OF THE ILLUSTRATED EMBODIMENT

Figures 1, 2, 3, 4:
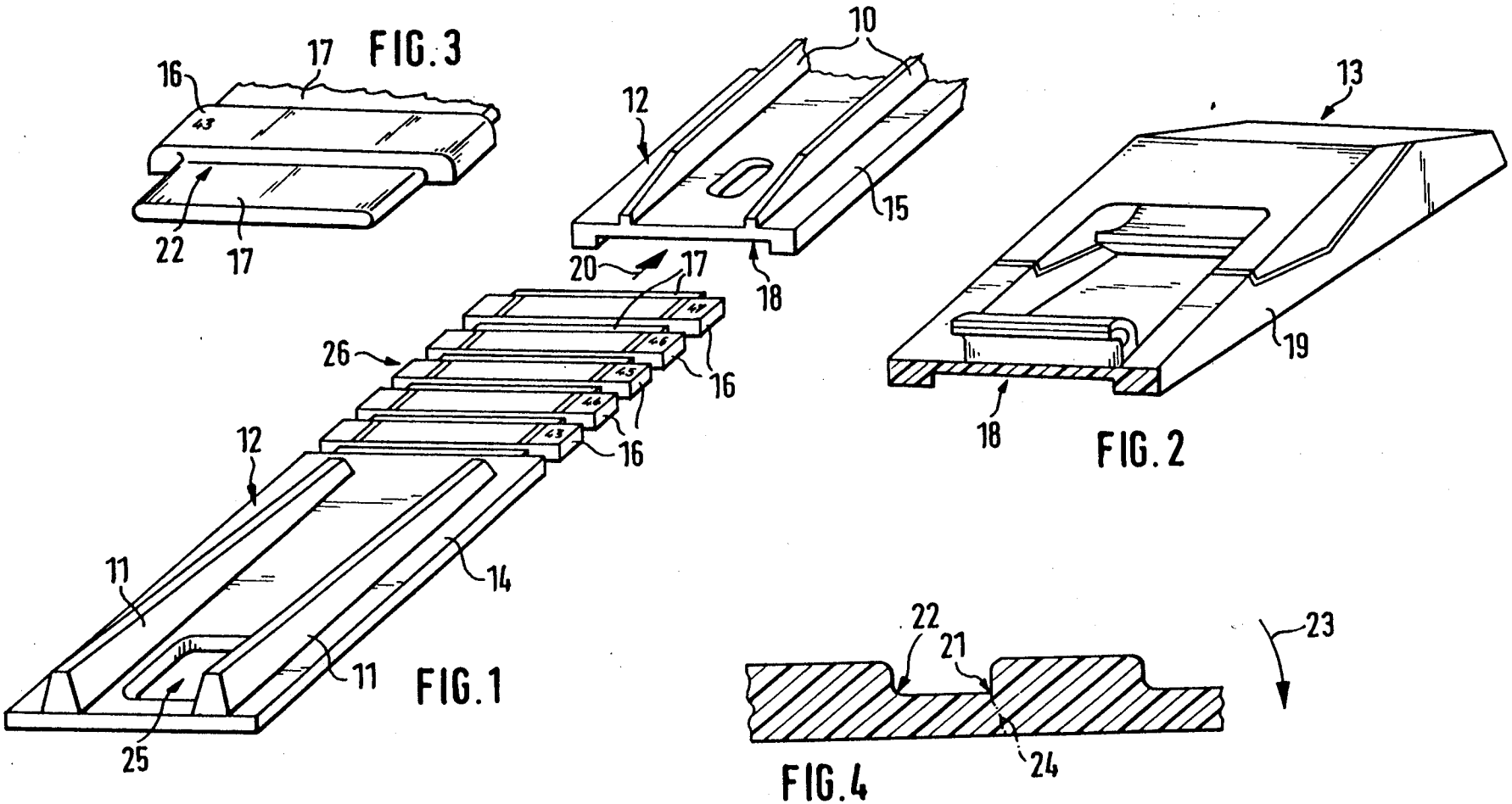
FIG. 1 is a perspective exploded view of a device presenting the features according to the present invention.
FIG. 2 shows a perspective view of a cross-country ski binding associated with the front section of a longitudinal guide rib or a longitudinal guide rib as a uniform component.
FIG. 3 is a perspective enlarged view of a breakable segment of the device illustrated in FIG. 1.
FIG. 4 is a sectional enlarged view of the junction between two breakable segments and a connecting crossbar therebetween.

The lateral guide device for a cross-country ski boot, which is illustrated in FIGS. 1, 3 and 4, is characterized by a pair of front guide ribs effective in the regions of the toes and the metatarsus, and by a pair of rear guide ribs which are mainly effective in the region of the heel of the foot or the shoe; the front guide ribs are designed as a front section 10 and the rear guide ribs constitute a rear section 11 of two mutually spaced guide ribs 12 which extend approximately parallel to each other and to the longitudinal extension of the ski or the boot, respectively. The front guide rib section 10 is joined to a cross-country ski binding which is not illustrated in FIG. 1, e.g. in a manner shown in FIG. 2, or is integrally or detachably connected to this binding. In FIG. 2 the reference numeral 13 indicates the binding while the reference numeral 19 applies to its housing. The function and the structure of the binding are not relevant here. It is therefore sufficient in this respect to refer to the specific binding of the ROTTEFELLER NNN-BC (BACKCOUNTRY) type which the applicant has recently presented, as an example.

Each of the rear guide ribs and likewise of the front guide ribs is disposed at the top side of a mounting plate 14 or 15, respectively, and manufactured of plastic material, specifically integral therewith. The front section or the section 26 of the mounting plate 14 for the rear section 11 of the guide ribs 12, which faces the front section 10 of the guide ribs, includes several, in this case five, segments 16 which may be broken off each either from each other and/or from the mounting plate 14; the length of each of these segments corresponds approximately to the difference in length between two or more of directly subsequent shoe sizes. According to FIG. 1, the shoe sizes 43, 44, 45, 46 and 47 are identified at the top side of the individual segments. As a function of the respective shoe size for which the guide device is to be used an appropriate number of segments 16 must be broken off. In the event that the device is to be used for shoe size 44, for instance, the three frontmost segments 16 must be broken off in the embodiment according to FIG. 1, before the rear guide rib section 11, inclusive of the mounting plate 14 and the remaining segments 16, will be attached, with positive locking action, to the front guide rib section 10 or its mounting plate 15. For the purpose of the positive locking connection mentioned last, and with a defined breaking of segments 16 in mind, a flat crossbar 17 is provided at the free front end of the foremost segment 16 as well as between the individual segments 16 and also between the rearmost segment 16 and the mounting plate 14. This crossbar freely projects into a complementary, rearwardly open transverse groove 18 either of the binding housing 19—if no front guide rib section is provided—or of the front guide rib section 10 connected thereto or the latter's mounting plate 15, respectively, for fitting in the direction of the arrow 20. The transverse groove 18 is provided (see FIG. 2) between the binding housing 19, on the one hand, and the body of the ski or the top surface of the ski, on the other hand. In the embodiment according to FIG. 1, which provides for one front guide rib section 10, the transverse groove 18 is defined between the front mounting plate 15, on the one hand, and the top surface of the ski, on the other hand. The respectively projecting crossbar 17 may be fitted within this transverse groove 18 with positive locking action.

According to FIGS. 3 and 4, the junction from the crossbar 17 to the respectively forward segment 16 is designed as an edged angle, specifically as an orthogonal angle 21, whilst the junction 22 towards the respectively rearward segment or rearward mounting plate 14 is rounded off. This provision allows for a defined breaking of segments in the direction of arrow 23 in FIG. 4 in a manner that one freely projecting crossbar 17 will always be retained which contributes to the aforementioned positively locking connection of the rear guide rib section 11 to the front section 10 or the binding housing 19, respectively. The rated breaking point which is defined by the edged angle 21 is indicated in the form of the breaking surface 24 defined by the broken lines in FIG. 4.

According to the illustrated embodiment, the underside of each of the crossbars 17 is flush with the underside of the segments 16 and/or the rear mounting plate 14.

In this manner, the transverse groove 18 may be provided at an appropriately deep level so that the structure of the overall arrangement may be comparatively flat or compact.

In the illustrated embodiment, the crossbars 17 are given reduced dimensions, compared against the segments 16, in terms of both width and height.

The rear guide rib section 11 may be manufactured as one plastic injection-molded component, inclusive of the mounting plate and the segments 16 as well as the crossbars 17, and specifically, in the illustrated design, in a so-called one-shot operation.

FIG. 1 moreover shows that the mounting plate 14, on whose top side the rear section 11 of the guide ribs 12 is designed, includes only a single opening 25 for a fastening screw (which is not illustrated) in the rear section, which opening is provided between the two rear longitudinal guide ribs. Due to the positive locking and thus torsion-resistant attachment of the rear guiding rib section 11 to the front guiding rib section 10, it is sufficient to provide only a single opening 25 or a single fastening screw, in distinction from conventional structures which require at least three fastening screws.

According to FIG. 1, the guiding ribs 12 present a rearwardly slightly increasing height in the region of their rear section 11. This design is particularly well suited for cross-country skiing tours including comparatively many and/or long downhill slides, as this embodiment ensures a good lateral guidance of the shoe heel even with a slightly lifted heel. This is expedient in the so-called Telemark style, too.

The disposition of breakable segments for adaptation of the longitudinal guide ribs 12 to different shoe sizes in the intermediate region, specifically in the region of the plantar arch, for instance, is particularly uncritical as in that zone the lateral guidance is sufficiently ensured by the front section of the longitudinal guide ribs, even when the heel is lifted. In terms of lateral guidance, the central zone of the longitudinal guide ribs is of minor relevance. Moreover, the provision of the breakable segments is a weak point in the aforementioned zone, which excels itself by an improved elastic bending behaviour. Thus in mounting, the aforedescribed structure may be accordingly well adapted to the arcuate shape of the top surface of the ski. Moreover, the structure is specifically well suited to respond to variations in the arcuate shape of the top surface when the skis are used.

All of the features disclosed in the application documents are claimed to be essential of the present invention to the extent by which they are novel, compared against prior art, either per se or in combinations.

I claim:

1. A lateral guide device for a ski boot having a sole and having means adapted to be connected to a binding unit (13) attached on a ski such that the heel may be tilted upwards relative to the ski, comprising a ski boot support having a securement unit for attachment to the top surface of a ski, said support having a rear heel section and having a front section and a plantar arch section between said heel section and said front section, said plantar arch section being attached to said rear heel section, said heel section and said front section each having at least one raised longitudinal guide rib unit (12) extending parallel to the front and to the back of the ski and adapted to mate with a complementing longitudinal groove in the underside of the sole of the ski boot, said guide rib unit providing lateral guidance of the ski boot in a rolling movement of the ski boot from an upwardly tilted position downwardly to a position approximately parallel to the ski, said plantar arch section (26) including at least one breakable segment (16), each said breakable segment including a front locking element of reduced cross-sectional area, said front section having a rearwardmost recessed locking element, one of said locking elements being a projecting element and the other of said elements being a recessed element adapted to matingly receive said projecting element and establishing said rearwardmost locking element in locking engagement with said front locking element of the forwardmost breakable segment (16) for connecting said plantar arch section to said front section and thereby to said ski.

2. The device of claim 1, including a plurality of said breakable segments (16) connected and extending forwardly from said rear heel section, the length of each breakable segment (16) having a length equal to the difference in length between at least two shoe sizes.

3. The device of claim 2, wherein each of said breakable segments (16) includes a transversely extending groove having front and rear edges (22 and 24), one of said edges (22 and 24) being constructed as a rated breaking point (21, 24), to be broken for reducing the remaining length of said plurality of breakable segments.

4. The device of claim 2, wherein each of said breakable segments includes a flat front breakaway crossbar (17) at the forward end of each breakable segment between said plurality of separable segments (16), said flat front crossbar forming said front locking element and projecting freely toward said front section, said rearwardmost locking element including a transverse groove (18) having a cross sectional area complementing said outer flat front crossbar for said connecting said plantar arch section to said front section.

5. The device of claim 4, wherein said transverse groove (18) is formed in a bottom surface of said front section.

6. The device of claim 4, wherein said breakaway crossbar (17) is integral with said segments and having a generally orthogonal angle at the front edge of the crossbar and a rounded connection at the rear edge of the crossbar.

7. The device of claim 4, wherein said segments including said crossbars (17) have a bottom surface in a common plane.

8. The device of claim 4, wherein said crossbar (17) has a width less than the rearward end of said breakable segment (16), and said crossbar is located generally centrally of the segment.

9. The device of claim 8, wherein said ski support includes a mounting plate (14) connecting said heel section and said plantar section including said breakable segments (16) and forming a one-piece component, and said component being formed of plastic.

10. The device of claim 1, wherein said heel section includes a mounting plate and said securement unit includes a single opening (25) for receiving a fastening screw for securing said ski boot support to the ski.

11. The device of claim 10, wherein said guide rib unit (12) includes two mutually spaced and approximately parallel longitudinal guide ribs (12), said single opening being located in said mounting plate between said two ribs.

12. The device of claim 1, wherein said raised longitudinal guide rib unit (12) has an increasing height from the forwardmost end in the front section to the rearwardmost end in the heel section of said ski boot support.

* * * * *

UNITED STATES PATENT AND TRADEMARK OFFICE

CERTIFICATE OF CORRECTION

PATENT NO. : 5,088,757

DATED : February 18, 1992

INVENTOR(S) : BERNT-OTTO HAUGHLIN

It is certified that error appears in the above-identified patent and that said Letters Patent is hereby corrected as shown below:

Claim 1, Col. 6, Line 17, after "rearwardmost" delete "recessed".

Signed and Sealed this

Twenty-sixth Day of October, 1993

*Attest:*

Bruce Lehman

BRUCE LEHMAN

*Attesting Officer*

*Commissioner of Patents and Trademarks*